US009873123B2

(12) United States Patent
Jonkka

(10) Patent No.: US 9,873,123 B2
(45) Date of Patent: Jan. 23, 2018

(54) JAW CRUSHER, A CRUSHING PLANT, AND A METHOD FOR USING A JAW CRUSHER

(71) Applicant: Metso Minerals, Inc., Helsinki (FI)

(72) Inventor: Jari Jonkka, Kangasala (FI)

(73) Assignee: Metso Minerals, Inc., Helsinki (FI)

( * ) Notice: Subject to any disclaimer, the term of this patent is extended or adjusted under 35 U.S.C. 154(b) by 0 days.

(21) Appl. No.: 15/129,144

(22) PCT Filed: Mar. 25, 2015

(86) PCT No.: PCT/FI2015/050201
§ 371 (c)(1),
(2) Date: Sep. 26, 2016

(87) PCT Pub. No.: WO2015/144987
PCT Pub. Date: Oct. 1, 2015

(65) Prior Publication Data

US 2017/0106372 A1 Apr. 20, 2017

(30) Foreign Application Priority Data

Mar. 28, 2014 (FI) ..... 20145293

(51) Int. Cl.
*B02C 1/00* (2006.01)
*B02C 1/04* (2006.01)
(Continued)

(52) U.S. Cl.
CPC ..... *B02C 1/04* (2013.01); *B02C 1/025* (2013.01); *B02C 21/026* (2013.01)

(58) Field of Classification Search
CPC .. B02C 1/04; B02C 1/026; B02C 1/10; B02C 25/00
(Continued)

(56) References Cited

U.S. PATENT DOCUMENTS 1,972,930 A 9/1934 Green
4,288,040 A * 9/1981 Miller ..... B02C 1/04 241/263
(Continued)

FOREIGN PATENT DOCUMENTS

JP 3133766 2/2001
JP 2003053204 2/2003
(Continued)

OTHER PUBLICATIONS

International Search Report and Written Opinion for International Application No. PCT/FI2015/050201 dated Jun. 19, 2015.
(Continued)

*Primary Examiner* — Faye Francis
(74) *Attorney, Agent, or Firm* — Andrus Intellectual Property Law, LLP

(57) ABSTRACT

A jaw crusher, a crushing plant, and a method for using a crusher. A toggle plate is coupled between a pitman and a rear end of the jaw crusher with bearings at the ends of the toggle plate. A bearing holder for the bearing is present at least at one end of the toggle plate. The bearing is transferred continuously in the bearing holder to a desired location between an upper limit and a lower limit, inclusive of the upper and lower limits, with a transfer member of the bearing holder, and thus the operating angle of the toggle plate in relation to a frame of the crusher and the stroke of the crusher are changed.

19 Claims, 4 Drawing Sheets

(51) Int. Cl.
*B02C 1/02* (2006.01)
*B02C 21/02* (2006.01)

(58) Field of Classification Search
USPC ..... 241/264, 266
See application file for complete search history.

(56) References Cited

U.S. PATENT DOCUMENTS

| | | | | |
|---|---|---|---|---|
| 4,398,674 | A * | 8/1983 | Dremann | B02C 1/025 241/264 |
| 4,765,546 | A * | 8/1988 | Stewart | B02C 1/043 241/266 |
| 5,110,057 | A | 5/1992 | Karra et al. | |
| 5,799,888 | A | 9/1998 | Hamaguchi et al. | |
| 6,375,105 | B1 * | 4/2002 | Haven | B02C 1/025 241/264 |
| 7,344,097 | B2 * | 3/2008 | Young | B02C 1/025 241/268 |
| 7,510,134 | B2 * | 3/2009 | Young | B02C 1/025 241/268 |
| 7,513,446 | B2 * | 4/2009 | Young | B02C 1/025 241/101.3 |
| 9,295,991 | B2 * | 3/2016 | Hartl | B02C 1/025 |
| 9,339,820 | B2 * | 5/2016 | Lindberg | B02C 1/025 |

FOREIGN PATENT DOCUMENTS

| | | |
|---|---|---|
| JP | 2005329369 | 12/2005 |
| JP | 2006247602 | 9/2006 |
| JP | 2007222752 | 9/2007 |
| WO | 2005007293 | 1/2005 |
| WO | 2008055315 | 5/2008 |

OTHER PUBLICATIONS

International Preliminary Report on Patentability for International Application No. PCT/FI2015/050201 dated May 24, 2016.
Search Report for Finnish Patent Application No. 20145293 dated May 11, 2014.

* cited by examiner

JAW CRUSHER, A CRUSHING PLANT, AND A METHOD FOR USING A JAW CRUSHER

CROSS-REFERENCE TO RELATED APPLICATIONS

This application claims priority to PCT/FI2015/050201 filed Mar. 25, 2015, and published in English on Oct. 1, 2015 as publication number WO 2015/144987, which claims priority to FI Application No. 20145293, filed Mar. 28, 2014, the disclosures of which are incorporated herein by reference.

TECHNICAL FIELD

The invention is related to a jaw crusher the pitman of which is fastened to a frame of the jaw crusher by means of a toggle plate.

BACKGROUND

Mineral material, such as rock, can be extracted from the ground for crushing by means of either explosions or excavation. The rock may also be natural stone and gravel, or construction waste. Both mobile crushers and stationary crushing applications are used for crushing. The material to be crushed is fed with an excavator or wheel loader to a feed hopper of a crusher or crushing plant, from where the material to be crushed may fall into the throat of the crusher, or a feeder transfers the rock material towards the crusher. The mineral material to be crushed may also be recyclable material, such as concrete, bricks, or asphalt.

Jaw crushers are suitable for, for example, rough crushing at quarries or crushing of construction material. According to the operating principle of the jaw crusher, crushing takes place against jaws, termed fixed and moving jaw.

A known jaw crusher comprises a pitman which is supported at an upper end by side plates of the jaw crusher's frame through an eccentric. A rear part of the jaw crusher's frame is fastened between the side plates. Below the eccentric, the pitman is supported by the rear part of the frame through a toggle plate. A tie rod is arranged between a lower part of the pitman and the rear part of the frame; the tie rod is spring-loaded and pulls the pitman backwards towards the toggle plate.

JP2003053204 presents a jaw crusher where a toggle plate is supported at its ends by bearings having two grooves for the toggle plate. The end of the toggle plate may be changed into the second groove in the bearing. In addition, the bearing may be turned, in which case the grooves will settle at different positions with regard to the crusher's frame or pitman. To change the angle of the toggle plate, at least the toggle plate must be detached from the crusher. To detach the toggle plate, sufficient space, time, and a number of people must be reserved. When detaching, one person holds the pitman up with a load belt, another holds the toggle plate up, and the third switches the place of the bearing, for example.

The object of the invention is to avoid or mitigate problems related to prior art and/or to provide new technical alternatives. One object of the invention is to improve the adjustability of the jaw crusher. One object of the invention is to improve occupational safety. One object of the invention is to improve the effectiveness of the jaw crusher.

SUMMARY

According to a first aspect of the invention, a jaw crusher is provided comprising:

a frame comprising side plates and a rear end arranged between the side plates;

an eccentric supported by the side plates;

a pitman coupled to the eccentric;

a toggle plate coupled to the jaw crusher between the pitman and the rear end with bearings at the ends of the toggle plate; and a bearing holder for a bearing at least at one end of the toggle plate; and the bearing holder comprising a bearing transfer member with which the bearing is configured to be continuously transferable in the bearing holder so that the operating angle of the toggle plate changes in relation to the frame of the crusher.

Preferably, the crusher comprises means for transferring the bearing in relation to the bearing holder and thus for transferring the end of the toggle plate in relation to the crusher's frame. Preferably, the crusher comprises means for moving the bearing coupled to the end of the toggle plate continuously in the bearing holder. Preferably, the continuous transfer of the bearing in the bearing holder takes place transversely in relation to the end of the toggle plate supported by the bearing. Preferably, the crusher comprises means for transferring the bearing to a desired location between an upper and a lower limit, inclusive of the upper and lower limit.

Preferably, changing the operating angle of the toggle plate in relation of the frame of the crusher changes the crusher's stroke.

Preferably, the bearing is configured to be continuously transferable in the bearing holder without dismantling the toggle plate's coupling to the jaw crusher. Preferably, the bearing is transferable within the bearing holder. Preferably, the transfer member is configured to influence the bearing installed in the bearing holder and transfer the bearing in relation to the bearing holder so that the end of the toggle plate is transferred in relation to the frame of the crusher. Preferably, the bearing coupled to the end of the toggle plate is continuously movable by the transfer member in the bearing holder so that the angle of the toggle plate in relation to the horizontal level changes.

Preferably, the bearing holder comprises a frame in which a trajectory having an upper and a lower limit is formed for the bearing, and at least one transfer member influencing the bearing is arranged in the frame of the bearing holder, through which transfer members the bearing is arranged to be continuously transferable along the trajectory to a desired location between the upper and lower limit, inclusive of the upper and lower limit.

Preferably, the transfer member comprises a screw and/or a hydraulic cylinder and/or an electric cylinder and/or an electric engine.

Preferably, an adjustment apparatus, such as a wedge adjustment apparatus, is arranged between the rear end and the bearing holder to adjust the distance between the toggle plate and the rear end.

Preferably, a continuously adjustable bearing holder is arranged between a front end of the toggle plate and the pitman.

Preferably, a continuously adjustable bearing holder is arranged between a rear end of the toggle plate and the rear end of the crusher.

Preferably, a first continuously adjustable bearing holder is arranged between the front end of the toggle plate and the pitman, and a second continuously adjustable bearing holder is arranged between the rear end of the toggle plate and the rear end of the crusher.

Preferably, a center line of the crusher's setting adjustment is arranged to pass in the bearing holder through the center point between the upper limit and lower limit of the bearing's trajectory.

Preferably, in an economy mode of crushing, the bearing on the side of the rear end of the toggle plate is adjusted in the bearing holder below a middle line of the bearing's trajectory, preferably at the lower limit of the trajectory, and/or the bearing on the side of the front end of the toggle plate is adjusted in the bearing holder above the middle line of the trajectory, preferably at the upper limit of the trajectory.

Preferably, in a power mode of crushing, the bearing on the side of the rear end of the toggle plate is adjusted in the bearing holder above the middle line of the trajectory, preferably at the upper limit of the trajectory, and/or the bearing on the side of the front end of the toggle plate is adjusted in the bearing holder below the middle line of the trajectory, preferably at the lower limit of the trajectory.

According to a second aspect of the invention, a crushing plant is provided comprising a frame and a jaw crusher comprising:

a frame comprising side plates and a rear end arranged between the side plates;

an eccentric supported by the side plates;

a pitman coupled to the eccentric;

a toggle plate coupled to the jaw crusher between the pitman and the rear end with bearings at the ends of the toggle plate; and a bearing holder for a bearing at least at one end of the toggle plate, and the bearing holder comprising a bearing transfer member with which the bearing is configured to be continuously transferable in the bearing holder without dismantling the coupling of the toggle plate with the jaw crusher so that the operating angle of the toggle plate changes in relation to the frame of the crusher.

Preferably, the crushing plant is a mobile crushing plant comprising a feeder and/or a sieve and/or a conveyor fastened to the frame.

According to a third aspect of the invention, a method for using a jaw crusher is provided, the jaw crusher comprising:

a frame comprising side plates and a rear end arranged between the side plates;

an eccentric supported by the side plates;

a pitman coupled to the eccentric;

a toggle plate coupled to the jaw crusher between the pitman and the rear end with bearings at the ends of the toggle plate; and a bearing holder for a bearing at least at one end of the toggle plate; and the method comprising transferring the bearing continuously in the bearing holder with a bearing transfer member comprised by the bearing holder, and thus changing the operating angle of the toggle plate in relation to the frame of the crusher.

Preferably, the bearing is transferred continuously in the bearing holder without dismantling the toggle plate's coupling to the jaw crusher. Preferably, the bearing is transferred within the bearing holder. Preferably, the transfer member influences the bearing installed in the bearing holder and the bearing is transferred in relation to the bearing holder and thus the end of the toggle plate is transferred in relation to the frame of the crusher. Preferably, the bearing coupled to the end of the toggle plate is continuously moved with the transfer member in the bearing holder and thus the angle of the toggle plate is changed in relation to the horizontal level.

Preferably, the bearing is transferred continuously to a desired location in the bearing holder in the trajectory formed in the bearing holder.

Preferably, the stroke of the crusher is continuously adjusted as desired by changing the angle of the toggle plate by means of the adjustable bearing holder, and the setting of the crusher is adjusted as desired with the adjustment apparatus arranged between the rear end and the bearing holder, and, preferably, the setting is kept the same as before the stroke was adjusted.

Preferably, the setting of the crusher is adjusted as desired by means of the setting adjustment apparatus arranged between the rear end and the bearing holder, and the stroke is continuously adjusted as desired by changing the angle of the toggle plate with the adjustable bearing holder, preferably, the stroke is kept the same as before the setting was adjusted.

Preferably, the average power of crusher drive is measured, and, in response to a value higher than the target value of the average power, the stroke is continuously adjusted to be smaller by changing the angle of the toggle plate by means of the adjustable bearing holder. Preferably, the average power is measured electrically in crushing drive.

Preferably, the pressure of a pressure cylinder of the toggle plate loaded with a pressure cylinder is measured, and, in response to the occurrence of a higher number of pressure peaks than allowed and/or peaks with higher pressure than allowed, the stroke is continuously adjusted to be smaller by changing the angle of the toggle plate by means of the adjustable bearing holder.

Preferably, the compression of the toggle plate is measured with a sensor fastened to the toggle plate, such as a strain gauge, and, in response to the occurrence of a higher number of compression peaks than allowed and/or peaks with higher compression than allowed, the stroke is continuously adjusted to be smaller by changing the angle of the toggle plate by means of the adjustable bearing holder.

Preferably, in the economy mode of crushing, the bearing on the side of the rear end of the toggle plate is adjusted in the bearing holder below the middle line of the bearing's trajectory, preferably at the lower limit of the trajectory, and/or the bearing on the side of the front end of the toggle plate in the bearing holder above the middle line of the trajectory, preferably at the upper limit of the trajectory.

Preferably, in the power mode of crushing, the bearing on the side of the rear end of the toggle plate is adjusted in the bearing holder above the middle line of the trajectory, preferably at the upper limit of the trajectory, and/or the bearing on the side of the front end of the toggle plate in the bearing holder below the middle line of the trajectory, preferably at the lower limit of the trajectory.

Preferably, the crusher is adjusted in the power mode to produce a large product range and capacity using a large stroke.

Preferably, the size of the crusher's product range is adjusted by changing the setting as desired with the setting adjustment apparatus arranged between the rear end of the frame and the bearing holder.

Preferably, the bearing is transferred in the bearing holder during the rotation of the eccentric, preferably during crushing.

Preferably, the continuous change area of the angle of the toggle plate using the adjustable bearing holder at one end of the toggle plate is ±10° or less.

Preferably, in embodiments where the rear and front ends of the toggle plate have the new bearing holder described in this specification, the angle of the toggle plate may be changed continuously by ±20° or less.

According to a fourth aspect of the invention, a method for using a jaw crusher is provided, in which crusher a toggle plate is coupled between a pitman and a rear end of the crusher with bearings at the ends of the toggle plate, and there is a bearing holder for the bearing at least at one end of the toggle plate, which method comprises transferring the bearing continuously in the bearing holder to a desired location between an upper and a lower limit, inclusive of the upper and lower limit, with a transfer member comprised by the bearing holder, and thereby changing the operating angle of the toggle plate as desired in relation to the frame of the crusher and the stroke of the crusher.

Changing the stroke of the crusher is simple with the bearing holder, because it is not necessary to detach the bearing holder and the toggle plate from the crusher. Using the bearing holder, the stroke of the crusher may be changed continuously.

Using the device according to the invention, the desired work stroke may be conveniently optimized in accordance with the material being fed and/or the desired end product, for example. The convenient and quick adjustment of the work stroke is also advantageous in situations where it is detected that the average power is higher than the desired value, for example. In such a case, the adjustment of the stroke takes place automatically or manually by transferring the position of the bearing of the toggle plate downwards within the bearing holder. This allows more service life for the structures of the crusher. In addition, customers have an opportunity to optimize the consumption of energy per crushed tonne, thus gaining added value for themselves.

The bearing of the toggle plate is transferably fastened to the setting adjustment bearing holder. Due to this, the setting adjustment bearing holder may be kept in place in the crusher to change the work stroke from power mode to economy mode, for example. Thereby, crushing may continue without any significant interruption.

Various embodiments of the present invention will only be or have only been described in connection with one or some of the aspects of the invention. A person skilled in the art will appreciate that any embodiment of an aspect of the invention may be applied in the same aspect and other aspects alone or in combination with other embodiments.

BRIEF DESCRIPTION OF THE FIGURES

The invention will now be described in the following by way of example with reference to the appended drawings.

DETAILED DESCRIPTION

In the following description, like references refer to similar parts. It should be noted that the figures are not to scale in all cases and that they mainly serve the purpose of illustrating embodiments of the invention.

Figure 1:
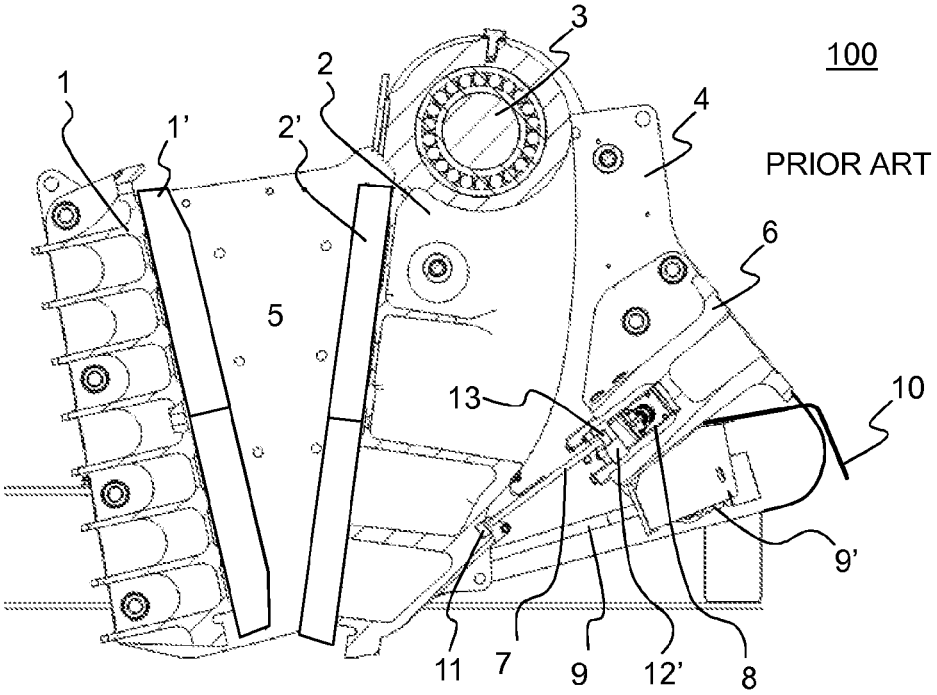
FIG. 1 shows a longitudinal cross section of a known jaw crusher.

FIG. 1 shows a jaw crusher 100 comprising a fixed law 1 as a front part of the jaw crusher and a pitman 2 as a moving jaw that is preferably supported at an upper end by side plates 4 of the jaw crusher's frame through an eccentric 3. The fixed jaw 1 and the moving jaw 2 form a crushing chamber 5 between them. A first wear part 1', which in the example in the figure is two-piece, is fastened to the fixed jaw 1. A second wear part 2', which in the example in the figure is two-piece, is fastened to the moving jaw 2. A rear part 6 of the jaw crusher's frame is fastened between the side plates 4 behind the pitman. The pitman is supported by the rear part of the frame through a toggle plate 7. An adjustment apparatus 8, for example a wedge adjustment apparatus, for the adjustment of the crusher's setting is arranged between a rear end of the toggle plate and the rear part 6 of the frame. In a wedge adjustment apparatus, the wedges can be controlled, e.g., manually by means of a screw(s) or hydraulically by means of a hydraulic cylinder(s). The adjustment apparatus 8 may also be implemented by one or several hydraulic setting adjustment cylinders that influence the toggle plate behind the toggle plate. A tie rod 9 is arranged between a lower end of the pitman and the rear part 6 of the frame; the tie rod is loadable by a spring 9'. When the spring 9' is tightened, the tie rod pulls the pitman 2 backwards against the toggle plate 7 and the toggle plate towards the rear part 6 of the frame.

The jaw crusher comprises a protective structure 10 located between the spring of the tie rod and the user. The protective structure comprises, for example, a protective plate fastened to the rear part 6.

A first bearing holder 11 is arranged between a front end of the toggle plate 7 and the lower end of the pitman. A second bearing holder 12' is arranged between the rear end of the toggle plate and the adjustment apparatus 8. The ends of the toggle plate are arranged in grooves of bearings in the bearing holder. A first end of the toggle plate is arranged in a first bearing in the first bearing holder 11, and a second end is arranged in a second bearing 13 in the second bearing holder 12'.

The bearing 13 in the second bearing holder 12' at the rear end of the toggle plate is up in FIG. 1. The bearing has two locations in relation to the rear end of the crusher, an upper location and a lower location. In a known solution, the toggle plate has exactly two operating angle areas. The location of the bearing in the second bearing holder and thus the position of the toggle plate may be switched to be lower by dismantling and detaching the toggle plate and the second bearing holder from the crusher, turning the second bearing holder around, and installing the turned around second bearing holder back on the crusher. After this, the bearing in the second bearing holder 12' is down compared with the position in FIG. 1, and the rear end of the toggle plate can be installed back on the bearing that is down in the second bearing holder.

Figure 2:
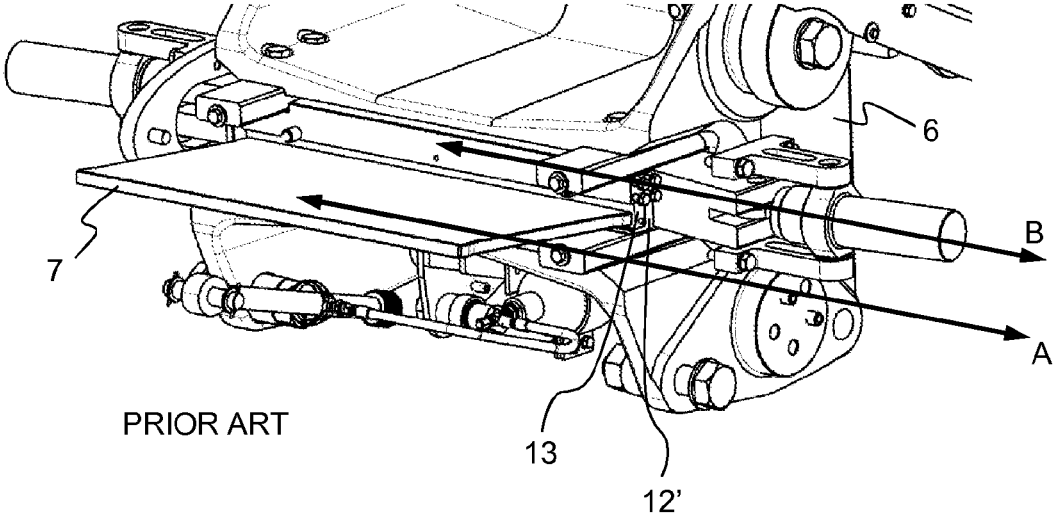
FIGS. 2-4 show known solutions for mounting the toggle plate with bearings on the crusher.
Figure 3:
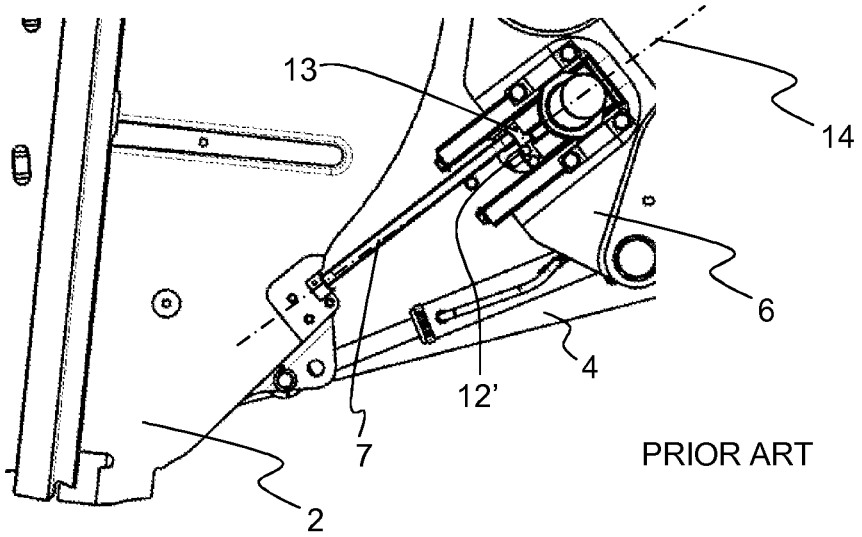
Figure 4:
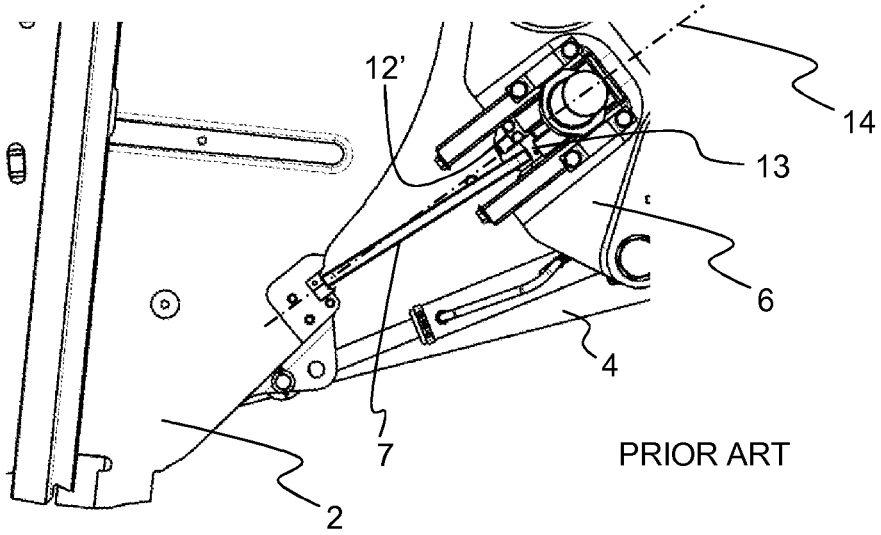

FIG. 2 shows a known bearing holder 12' for the setting adjustment of the jaw crusher 100, where the bearing 13 at the rear end of the toggle plate is fastened in place so that the work stroke can be changed from a power mode to an economy mode, for example, by turning the bearing holder. To implement this, both the toggle plate 7 (arrow A) and the bearing holder 12' (arrow B) have to be dismantled and detached from the crusher and installed back on the crusher. FIG. 3 shows the power mode where the bearing holder 12' is installed in a position where the bearing 13 at the rear end of the toggle plate 7 is above a middle line 14 of setting adjustment. FIG. 4 shows the economy mode where the bearing holder 12' is installed in a position where the bearing 13 of the toggle plate 7 is below the middle line 14 of setting adjustment.

By means of a new arrangement shown in FIGS. 5-9, it is possible to adjust the stroke of a jaw crusher 100 continuously. The position of bearing 13 at a front end and/or rear end of a toggle plate 7 may be adjusted continuously within a new bearing holder 12, for example, by turning screws 22 used as transfer members or by using at least one cylinder, for example (not shown in the figures).

In the examples shown in FIGS. 5-9, a bearing holder arranged at the rear end of the toggle plate is described, but according to the idea of some embodiments of the invention, a new bearing holder described in this specification may be located at the front end of the toggle plate.

On changing the position of the bearing 13 at the rear end of the toggle plate 7 in the bearing holder 12, the position of the rear end of the toggle plate is also transferred. Thereby, the angle of the toggle plate (the operating angle area) changes in relation to joints formed by a pitman 2 and an axle 3 of an eccentric, whereby the size of the work stroke of the crusher changes in the lower part of a crushing chamber 5, in particular. In the lower part of the crushing chamber 5, the change in the size of the work stroke has the largest impact on the capacity, power, and product range of the crusher.

Figure 5:
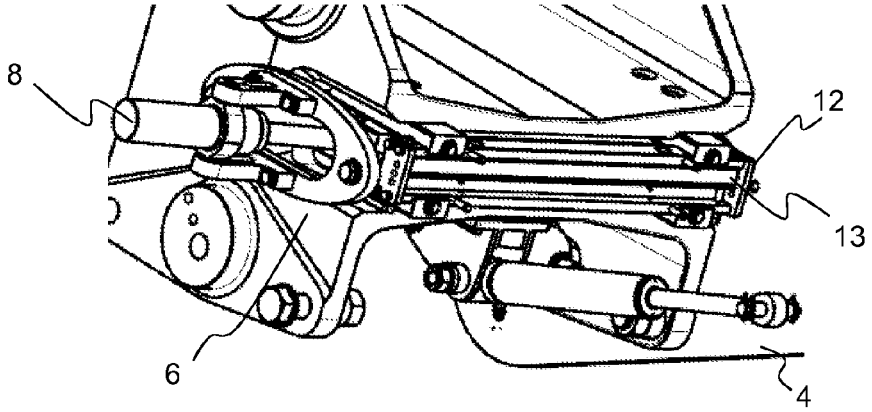
FIGS. 5-9 show new bearing holder solutions which may be applied to the jaw crusher of FIG. 1, for example, instead of a traditional bearing holder.

FIG. 5 shows the bearing holder 12 fastened to a rear end 6 of the crusher's frame. An adjustment apparatus 8 is located between the bearing holder 12 and the rear end 6. The bearing 13 at the rear end of the toggle plate is fastened so that by moving the bearing holder continuously it is possible to change the work stroke from a power mode to an economy mode, for example. To implement this, it is not necessary to dismantle and detach the toggle plate and the bearing holder from the crusher and install them back on the crusher.

Figure 6:
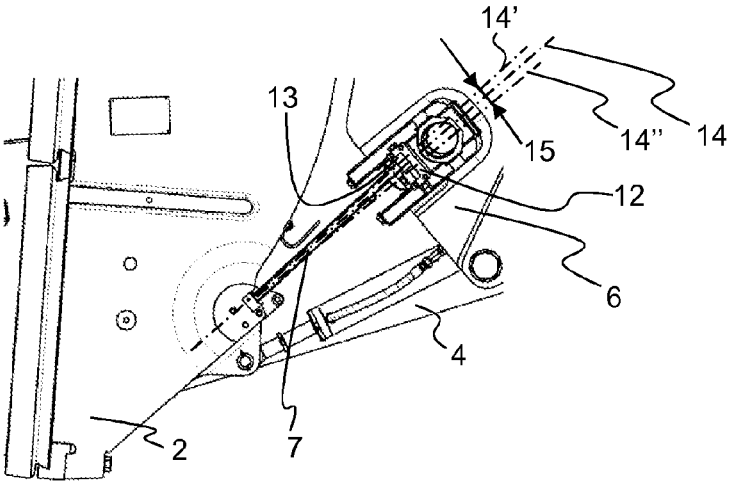

FIG. 6 shows the power mode where the bearing holder 12 is installed in a position where the bearing 13 at the rear end of the toggle plate 7 is above a middle line 14 of setting adjustment. An upper position of the angle of the toggle plate 7 is shown using line 14'. A lower position of the angle of the toggle plate 7 is shown using line 14". The change area of the angle of the toggle plate 7 is marked with reference number 15. In the power mode, the stroke of the crusher has been increased compared with the position of the toggle plate at the middle line 14.

Figure 7:
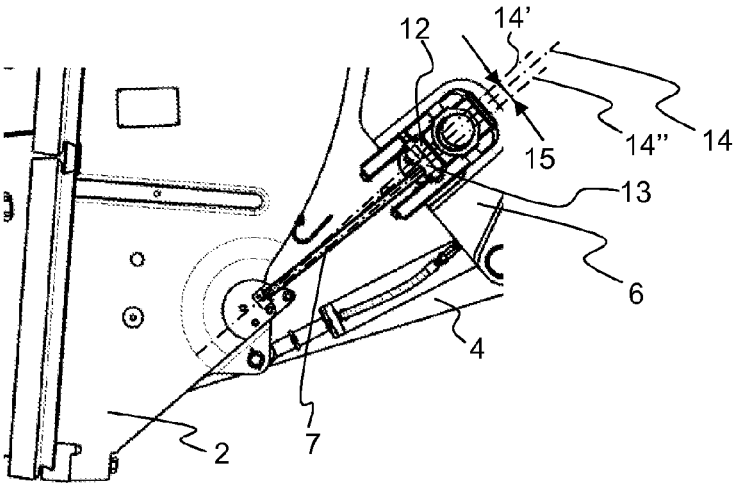

FIG. 7 shows the economy mode, wherein the bearing holder 12 is installed in a position where the bearing 13 of the toggle plate 7 is below the middle line 14 of setting adjustment. In the economy mode, the stroke of the crusher has been decreased compared with the position of the toggle plate at the middle line 14.

A person skilled in the art understands that, in the examples in the figures, the angle of the toggle plate is shown when the pitman is at a specific location where the rotating position of the eccentric and the location of an upper end of the toggle plate determine the trajectory of the pitman. The change in the angle of the toggle plate, i.e., the change in the operating angle area of the toggle plate, is shown for the sake of simplicity when the pitman is at a specific location.

Figure 8:
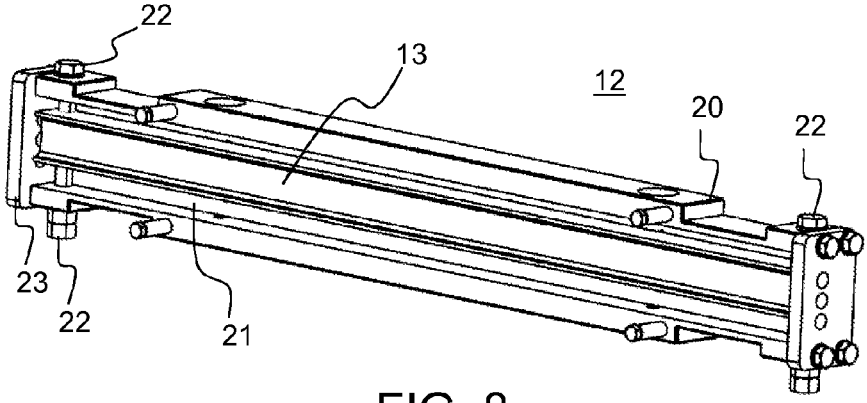

The bearing holder 12 shown in FIG. 8 comprises a frame 20 in which a trajectory 21 has been formed for the bearing 13. At an upper limit of the trajectory, an upper edge of the bearing meets an upper edge of the groove formed in the frame, and at a lower limit a lower edge of the bearing meets a lower edge of the groove. Screws as a transfer member 22 influencing the bearing have been arranged in the frame of the bearing holder, preferably at the ends of the frame to make adjustment work easier, with which screws the bearing is arranged to be continuously transferable along the trajectory to a desired location between the upper limit and lower limit, inclusive of the upper and lower limit. There are end parts 23 at the sides of the frame 20 to restrict the lateral movement of the bearing 13.

Figure 9:
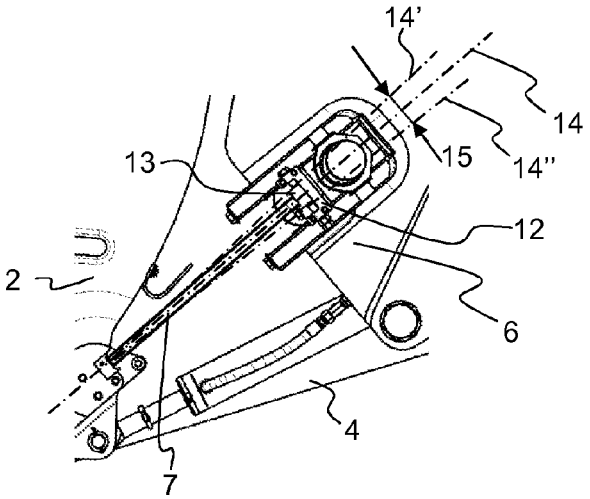

In FIG. 9, the bearing holder 12 has been installed in a position determined by the middle point of the movement area of the bearing at the rear end of the toggle plate, where the bearing 13 of the toggle plate 7 is at the middle line 14 of setting adjustment.

The continuous change area 15 of the angle of the toggle plate 7 using the adjustable bearing holder 12 at one end of the toggle plate may in some embodiments be ±10° and in other embodiments preferably ±5°.

In embodiments where the new bearing holder described in this specification is used at the rear end and front end of the toggle plate, the angle of the toggle plate may be changed continuously by ±20°, preferably by ±10°.

When the bearing holder that enables the continuous transfer of the end of the toggle plate has been installed at both ends of the toggle plate, the adjustment area of the toggle plate's inclination angle may be increased to be double compared with the situation where a bearing transfer device located at one end of the toggle plate is applied.

The transfer distance of the bearing 13 in the bearing holder 12 may be determined in an application-specific manner, wherein the transfer distance depends on the length of the toggle plate and the other dimensions of the crusher. In large crushers, the transfer distance is preferably larger, and in small crushers the transfer distance is smaller.

Using continuous adjustment, the crushing force and travel distance of the pitman within the adjustment area may be fine-tuned within the limits of the adjustment area.

Because it is not necessary to dismantle and detach the toggle plate and/or bearing holder and/or bearing from the crusher, it becomes easier to use the crusher. It also becomes easier to use and adjust the crusher in difficult conditions while effects of cold, freezing, and/or dust can be decreased.

Preferably, the stroke of the crusher may in some cases be decreased by changing the position of the toggle plate during use so that the crushes endures momentary peak loading, for example, when non-crushing or harder material than usual is observed in the crusher. The adjustable bearing holder of the toggle plate allows increasing the service life of the crusher and the crusher components.

The bearing holder 12 adjusting the angle of the toggle plate 7 may be used as a safety device of the crusher, for example, if the bearing holder 12 transferring the location of the bearing 13 is coupled to other crushing automation of the crusher, where the measurement of the loading of the crusher is used in adjustment. In a crusher loading situation observed via the crushing automation, for example, in a situation where loading is higher than the targeted loading of the crusher; the crushing automation controls the location of the bearing 13 to be transferred in the bearing holder 12 and thus the crushing automation controls the angle of the toggle plate to be changed.

The following situations, for example, are situations where the loading of the crusher is higher than the targeted loading:

- the average power measured in driving of the crusher is higher than the target value;

pressure peaks occur more often than allowed and/or with higher than allowed pressure in the pressure cylinder of a toggle plate loaded with a pressure cylinder;

compression peaks are observed more often than allowed and/or with higher then allowed compression through a device measuring the compression of the toggle plate, e.g., a sensor attached to the toggle plate, such as a strain gauge.

Figure 10:
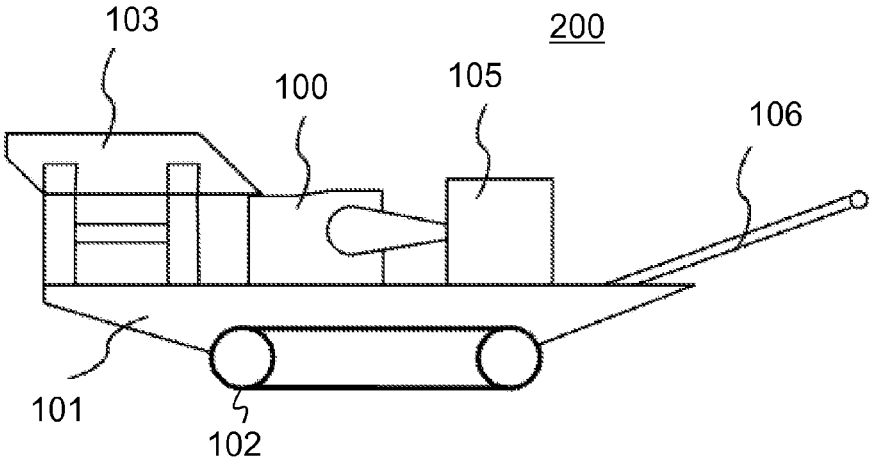
FIG. 10 shows a processing plant of mineral material according to the invention that preferably comprises a crusher in accordance with the invention.

FIG. 10 shows a mobile crushing plant of mineral material 200 comprising a jaw crusher 100 in accordance with an embodiment of the invention, at one end or both ends of a toggle plate 7 of which is arranged a new bearing holder 12 shown in FIGS. 5-9.

The crushing plant comprises a feeder 103 to feed material to the jaw crusher 100, and a belt conveyor 106 to transport the crusher product farther away from the crushing plant. The crushing plant 200 also comprises a power supply and a control center 105. The power supply may be a diesel or electric engine, for example, which provides energy for the use of process units and hydraulic circuits.

The feeder, crusher, power supply, and conveyor are fastened to a frame 101, which in this embodiment also comprises a track base 102 for moving the crushing plant. The crushing plant may also entirely or partly comprise a wheel base or be movable with feet. Alternatively, the crushing plant may be movable/towable by means of a truck or another external power supply. In addition to the above, the crushing plant may also be a fixed crushing plant.

Typically, attempts are made to make a mobile crushing plant as compact as possible, with the result that there is little room to work in the mobile crushing plant. In relation to the mobile crushing plant, the same benefits may be obtained as presented in this specification in relation to a crusher equipped with the new bearing holder. The adjustment of the mobile crushing plant is easier when the position of the toggle plate can be changed without detaching the toggle plate from the crusher. In the case where the angle position of the toggle plate is adjusted automatically via the automation of the crushing plant, the user does not need to move anything manually, and the angle of the toggle plate may be changed during the crushing process. Usually movable plants are equipped with ready automation. The new continuously adjustable transfer arrangement of the angle of the toggle plate may be easily coupled as part of the automation system existing in the crushing plant. In an automated version, moving a transfer member used for adjusting the stroke may be implemented by an electric engine connected to a screw; the electric engine may be, e.g., a servomotor which allows determining the location of a bearing at the end of the toggle plate. A hydraulic or mechanical sensor arrangement may be used to determine the location of the bearing at the end of the toggle plate.

Without in any way restricting the scope of protection, interpretation, or potential applications of the invention, the improvement of occupational safety may be considered a technical advantage of the different embodiments of the invention. Furthermore, facilitation of work and ergonomics can be considered a technical advantage of the different embodiments of the invention. Moreover, the shortening of the period needed to change the position of the toggle plate can be considered a technical advantage of the different embodiments of the invention. In addition, the acceleration of the adjustment of the stroke of the jaw crusher can be considered a technical advantage of the different embodiments of the invention.

The above specification provides non-restrictive examples of some embodiments of the invention. It is clear to a person skilled in the art that the invention is not, however, restricted to the details presented, but the invention may also be implemented in other, equivalent ways.

Some features of the embodiments presented may be utilized without the use of other features. The specification presented above shall, as such, be considered an explanation describing the principles of the invention and not to restrict the invention. The scope of protection of this invention is only restricted by the appended claims.

The invention claimed is:

1. A jaw crusher comprising:

a frame comprising side plates and a rear end arranged between the side plates;

an eccentric supported by the side plates;

a pitman coupled to the eccentric;

a toggle plate coupled to the jaw crusher between the pitman and the rear end of the frame with bearings at front and rear ends of the toggle plate; and a bearing holder for the bearing at least at one of the front and rear ends of the toggle plate;

wherein the bearing holder comprises a transfer member of the bearing with which the bearing is configured to be continuously transferable to a desired location in the bearing holder between an upper limit and a lower limit, inclusive of the upper limit and the lower limit, so that an operating angle of the toggle plate in relation to the frame of the crusher and a stroke of the crusher change.

2. A jaw crusher in accordance with claim 1, wherein the bearing holder comprising a frame in which a trajectory is formed for the bearing, the trajectory having an upper limit and a lower limit; and at least one transfer member influencing the bearing being arranged in the frame, with which at least one transfer member the bearing is arranged to be continuously transferable along the trajectory to a desired location between said upper limit and said lower limit, inclusive of the upper limit and the lower limit.

3. A crusher in accordance with claim 2, having a middle line of crusher setting adjustment arranged to pass in the bearing holder through a middle point between the upper limit and the lower limit of the trajectory.

4. A jaw crusher in accordance with claim 1, wherein the transfer member is selected from the group consisting of a screw, a hydraulic cylinder, an electric cylinder and an electric engine.

5. A jaw crusher in accordance with claim 1, wherein the jaw crusher further comprises a wedge adjustment apparatus arranged between the rear end of the frame and the bearing holder to adjust the distance between the toggle plate and the rear end of the frame.

6. A jaw crusher in accordance with claim 1, wherein the crusher further comprises a continuously adjustable bearing holder arranged between the front end of the toggle plate and the pitman.

7. A crusher in accordance with claim 1, wherein the crusher further comprises a continuously adjustable bearing holder arranged between the rear end of the toggle plate and the rear end of the frame.

8. A crusher in accordance with claim 1, wherein the crusher further comprises a first continuously adjustable bearing holder arranged between the front end of the toggle plate and the pitman and a second continuously adjustable bearing holder arranged between the rear end of the toggle plate and the rear end of the frame.

9. A crusher in accordance with claim 1, having at least one of the following adjusted in an economy mode of crushing:

the bearing on the rear end of the toggle plate in the bearing holder below a middle line of the trajectory, preferably at the lower limit of the trajectory; and the bearing on the front end of the toggle plate in the bearing holder above the middle line of the trajectory, preferably at the upper limit of the trajectory.

10. A crusher in accordance with claim 1, wherein at least one of the following being adjusted in the crusher in a power mode of crushing:

the bearing on the rear end of the toggle plate in the bearing holder above a middle line of the trajectory, preferably at the upper limit of the trajectory; and the bearing on the front end of the toggle plate in the bearing holder below the middle line of the trajectory, preferably at the lower limit of the trajectory.

11. A crushing plant comprising:

a jaw crusher;

a frame comprising side plates and a rear end arranged between the side plates;

an eccentric supported by the side plates;

a pitman coupled to the eccentric;

a toggle plate coupled between the pitman and the rear end of the frame with bearings at front and rear ends of the toggle plate; and a bearing holder for a bearing at least at one of the front and rear ends of the toggle plate;

the bearing holder comprising a bearing transfer member, with which the bearing is configured to be continuously transferable in the bearing holder along a trajectory to a desired location between an upper limit and a lower limit, inclusive of the upper limit and the lower limit, without dismantling the coupling of the toggle plate to the pitman and the rear end of the frame, so that an operating angle area of the toggle plate in relation to the frame of the crusher and a stroke of the crusher change.

12. A crushing plant in accordance with claim 11, the crushing plant being a mobile crushing plant comprising at least one of the following fastened to the frame: a feeder; a sieve; and conveyor.

13. A method for using a jaw crusher comprising:

providing a frame comprising side plates and a rear end arranged between the side plates;

providing an eccentric supported by the side plates;

providing a pitman coupled to the eccentric;

providing a toggle plate coupled to the jaw crusher between the pitman and the rear end with bearings at front and rear ends of the toggle plate; and providing a bearing holder for the bearing at least at one of the front and rear ends of the toggle plate;

wherein the method further comprises the step of transferring the bearing continuously in the bearing holder to a desired location between an upper limit and a lower limit, inclusive of the upper limit and the lower limit, with a bearing transfer member comprised by the bearing holder, and thereby changing an operating angle of the toggle plate in relation to the frame of the crusher and a stroke of the crusher.

14. A method in accordance with claim 13, further comprising the step of transferring the bearing continuously to a desired location in the bearing holder in a trajectory formed in the bearing holder.

15. A method in accordance with claim 13, further comprising the steps of:

adjusting the stroke of the crusher continuously as desired by changing the operating angle of the toggle plate by means of the adjustable bearing holder; and adjusting a setting of the crusher as desired with a setting adjustment apparatus arranged between the rear end of the toggle plate and the bearing holder.

16. A method in accordance with claim 15, further comprising the step of keeping the setting the same as before the stroke was adjusted.

17. A method in accordance with claim 13, further comprising the steps of:

adjusting a setting of the crusher as desired with the setting adjustment apparatus arranged between the rear end of the toggle plate and the bearing holder; and adjusting the stroke continuously as desired by changing the operating angle of the toggle plate by means of the adjustable bearing holder.

18. A method in accordance with claim 17, further comprising the step of keeping the stroke the same as before the setting was adjusted.

19. A method in accordance with claim 13, further comprising the step of decreasing the stroke of the crusher by changing the position of the toggle plate during use so that the crusher endures momentary peak loading for increasing a service life of the crusher and a service life of the crusher components with the adjustable bearing holder of the toggle plate.

* * * * *